US007858027B2

(12) United States Patent
Trissel

(10) Patent No.: US 7,858,027 B2
(45) Date of Patent: Dec. 28, 2010

(54) RAZOR PROTECTION SYSTEM

(76) Inventor: Brett J. Trissel, 1831 Ferndale Rd. NW., Canton, OH (US) 44709

( * ) Notice: Subject to any disclaimer, the term of this patent is extended or adjusted under 35 U.S.C. 154(b) by 360 days.

(21) Appl. No.: 12/026,260

(22) Filed: Feb. 5, 2008

(65) Prior Publication Data

US 2008/0189965 A1 Aug. 14, 2008

Related U.S. Application Data

(60) Provisional application No. 60/900,133, filed on Feb. 8, 2007.

(51) Int. Cl.
*C23F 11/00* (2006.01)
*B65D 81/24* (2006.01)
*A45C 11/00* (2006.01)

(52) U.S. Cl. ..... 422/7; 422/40; 206/208; 206/352; 137/3

(58) Field of Classification Search ..... 206/207, 206/208, 209, 210, 352, 354, 806, 459.5, 206/459.1; 30/541; 422/7, 28, 40; 137/3
See application file for complete search history.

(56) References Cited

U.S. PATENT DOCUMENTS

| | | | | |
|---|---|---|---|---|
| 1,552,583 | A | 9/1925 | Stokes et al. | |
| 1,618,661 | A | 2/1927 | Humbert | |
| 1,974,175 | A | 9/1934 | Coggins | |
| 1,978,716 | A | 10/1934 | Morehouse | |
| 1,981,853 | A * | 11/1934 | Bruce | 206/208 |
| 1,983,011 | A | 12/1934 | Toll | |
| 2,027,899 | A * | 1/1936 | Bruce | 30/541 |
| 2,077,246 | A | 4/1937 | Mayr | |
| 2,465,440 | A | 3/1949 | Fleckenstine | |
| 2,748,413 | A | 6/1956 | Morrow | |
| 3,019,494 | A * | 2/1962 | Horie et al. | 206/208 |
| 3,352,630 | A * | 11/1967 | Fischer et al. | 206/208 |
| 3,611,989 | A * | 10/1971 | Lovelace | 118/428 |
| 4,198,745 | A | 4/1980 | Moehlenpah | |
| 4,562,644 | A | 1/1986 | Hitchens | |
| 4,890,348 | A | 1/1990 | Racioppi | |
| 4,945,598 | A | 8/1990 | Racioppi | |
| 5,007,533 | A * | 4/1991 | Purohit | 206/208 |
| 5,072,512 | A | 12/1991 | Noujain | |
| 5,141,349 | A | 8/1992 | Maquire, Jr. et al. | |
| 5,251,752 | A * | 10/1993 | Purohit | 206/352 |
| 5,319,852 | A | 6/1994 | Metzger | |
| 5,468,496 | A * | 11/1995 | Touzan et al. | 424/401 |
| 5,862,816 | A * | 1/1999 | Lowe | 132/291 |
| 5,934,459 | A * | 8/1999 | Winsell | 206/208 |
| 6,009,622 | A | 1/2000 | Liedblad | |
| 6,102,055 | A | 8/2000 | Karnatz | |

(Continued)

*Primary Examiner*—J. Gregory Pickett
(74) *Attorney, Agent, or Firm*—Sand & Sebolt

(57) ABSTRACT

A razor protection system includes a container for holding a protective liquid such as mineral oil for protecting the razor of a non-electric shaver. The protective liquid floats on water, which is used to control the level of the protective liquid. A shaver support adjacent the container supports the razor within the container spaced upwardly from the bottom the container above the water. In one embodiment, the shaver support is movable to alternately immerse the razor in the protective liquid and remove the razor from the protective liquid. The shaver support preferably supports the shaver when the razor is not immersed to allow the protective liquid to drip from the razor into the container.

18 Claims, 8 Drawing Sheets

U.S. PATENT DOCUMENTS

| | | | | |
|---|---|---|---|---|
| D431,478 | S * | 10/2000 | Fortier | D10/46.2 |
| 6,145,657 | A * | 11/2000 | Cox | 206/208 |
| 6,449,796 | B1 | 9/2002 | Severino | |
| 6,634,492 | B1 * | 10/2003 | Cox | 206/208 |
| 6,886,211 | B2 | 5/2005 | Severino | |
| 7,107,692 | B2 | 9/2006 | Kappes et al. | |
| 7,143,517 | B2 * | 12/2006 | Kappes et al. | 30/538 |
| 7,159,324 | B2 | 1/2007 | Worrick, III | |
| 2003/0015246 | A1 * | 1/2003 | Hardin | 138/97 |
| 2003/0148030 | A1 | 8/2003 | Vernon et al. | |
| 2009/0211100 | A1 * | 8/2009 | Winsell | 30/41 |

* cited by examiner

RAZOR PROTECTION SYSTEM

CROSS REFERENCE TO RELATED APPLICATION

This application claims priority from U.S. Provisional Application Ser. No. 60/900,133 filed Feb. 8, 2007; the disclosure of which is incorporated herein by reference.

BACKGROUND OF THE INVENTION

1. Technical Field

The present invention is generally related to a razor protection system for protecting razors or razor blades of a hand-held non-electric shaver. More particularly, the present invention relates to such a shaving system in which the razor is support within a container spaced upwardly from its bottom wall so that the razor remains in a protective liquid which floats on water within the container.

2. Background Information

As is broadly known, a shaving razor of a non-electric shaver gradually dulls overtime. A substantial portion of this dulling process is due to the oxidation of the razor and thus razor protection systems have been developed in which the razor is immersed in a protective liquid such as mineral oil when not in use. During use, the container of these protective systems gradually accumulates water and clippings of facial or other hair from the razor. Thus, the mineral oil must be changed on a regular basis. In addition, the water which builds up within the container may come into contact with the razor and thus reduce the ability of the mineral oil to protect the razor. Moreover, as the clippings of hair build up at the bottom of the container the razor will be in contact with these clippings, which may thus remain attached to the razor when withdrawn from the mineral oil for use. Furthermore, when the razor is withdrawn from the mineral oil, the oil naturally drips from the razor and thus adds to the possibility of dripping the oil in undesired places unless it is held over the container by hand or wiped off or washed off in some manner. Thus, there are several aspects of the presently known systems which leave room for improvement.

BRIEF SUMMARY OF THE INVENTION

The present invention provides a razor protection system for use with a shaver having a handle, a head secured to the handle and a razor carried by the head, the system comprising: a container; a liquid-receiving cavity formed in the container adapted to contain a protective liquid suitable for protecting against oxidation of the razor when immersed therein; a bottom wall on the container bounding the cavity; and a shaver support adjacent the container adapted to support the shaver in a first position with its razor and head spaced upwardly from the bottom wall within the cavity.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
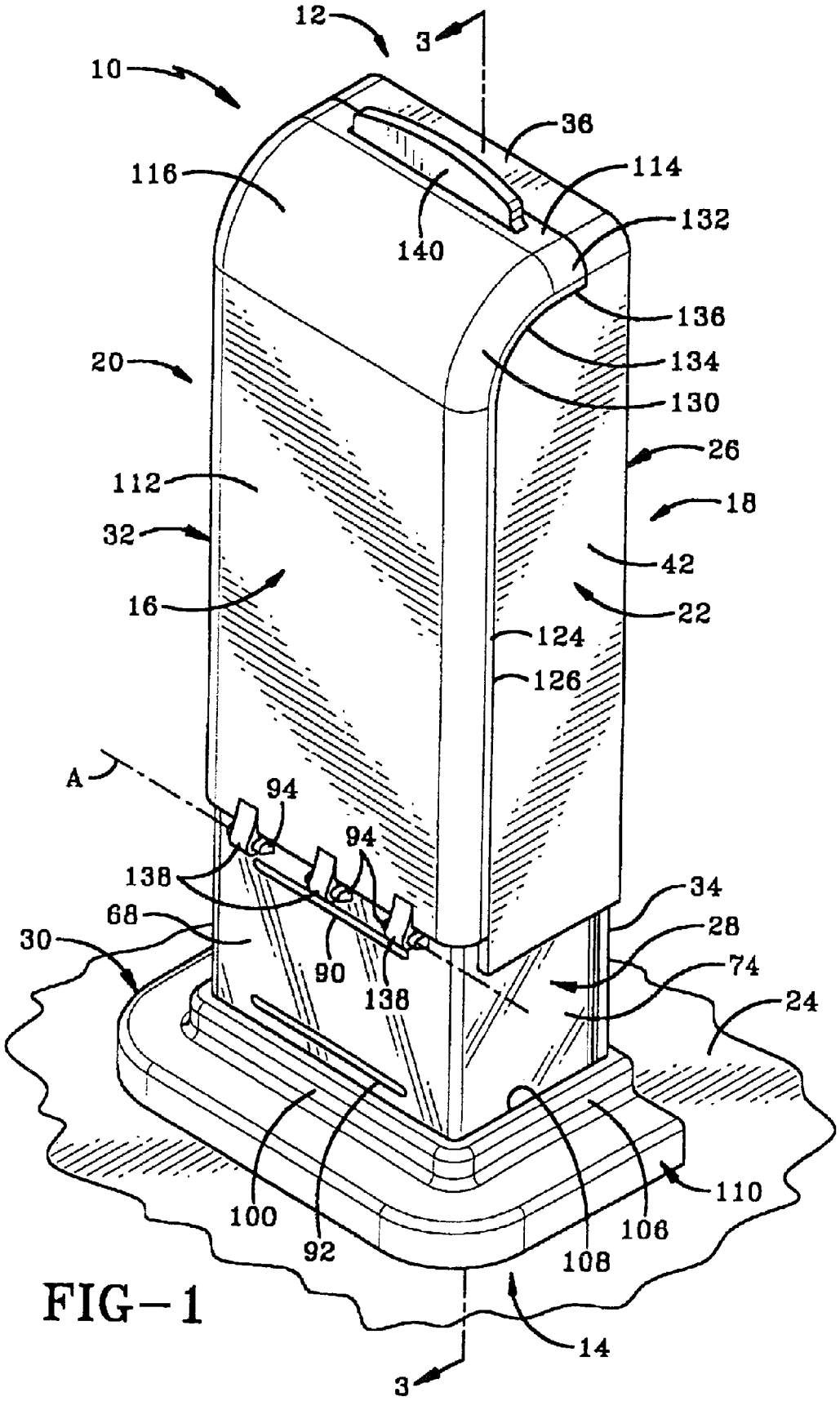
FIG. 1 is a perspective view of a first embodiment of the razor stand of the present invention.
Figure 2:
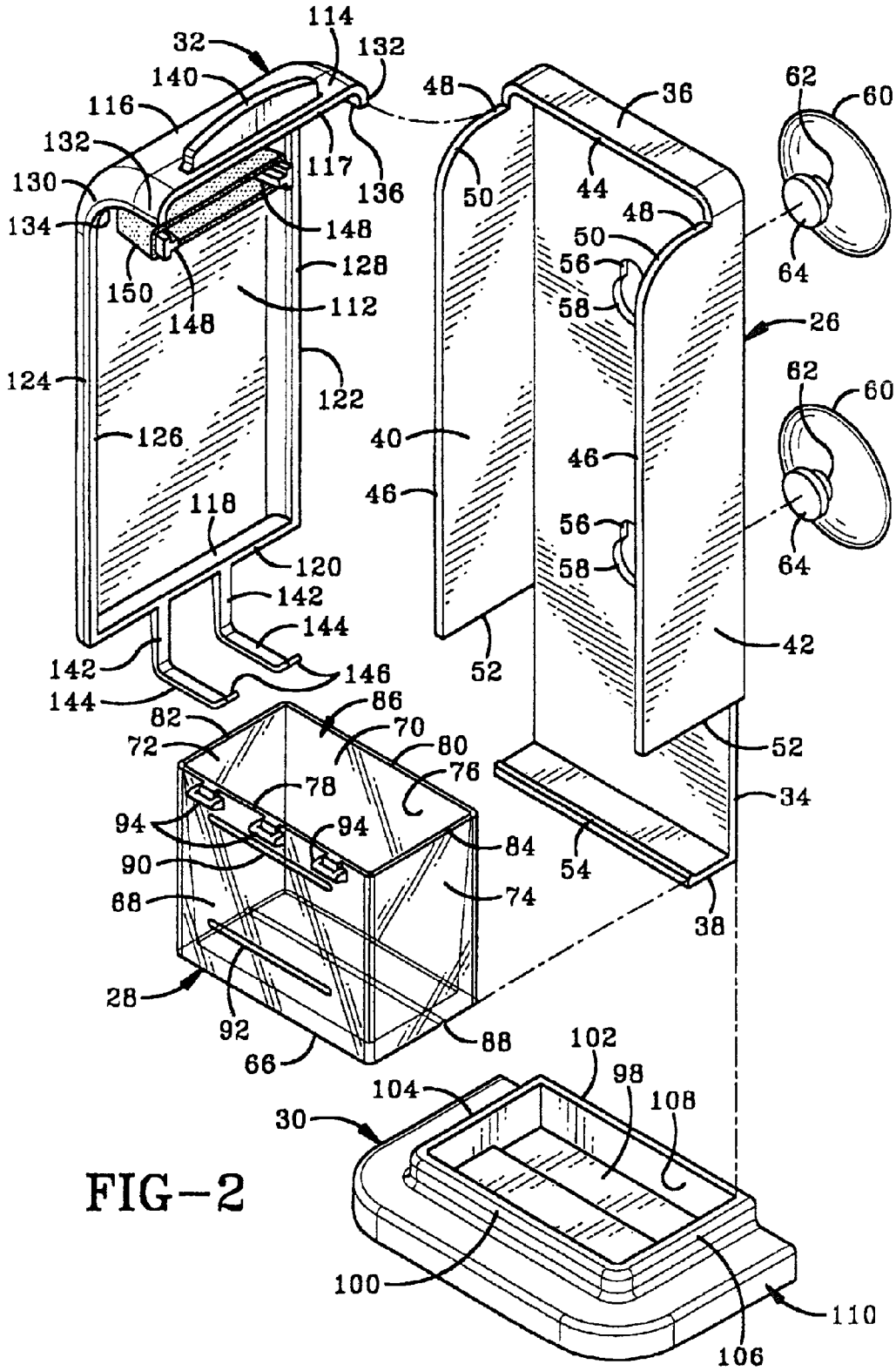
FIG. 2 is an exploded perspective view of the first embodiment with the cover and shaver support rotated 90 degrees relative to the other components to show its inner features.
Figure 5:
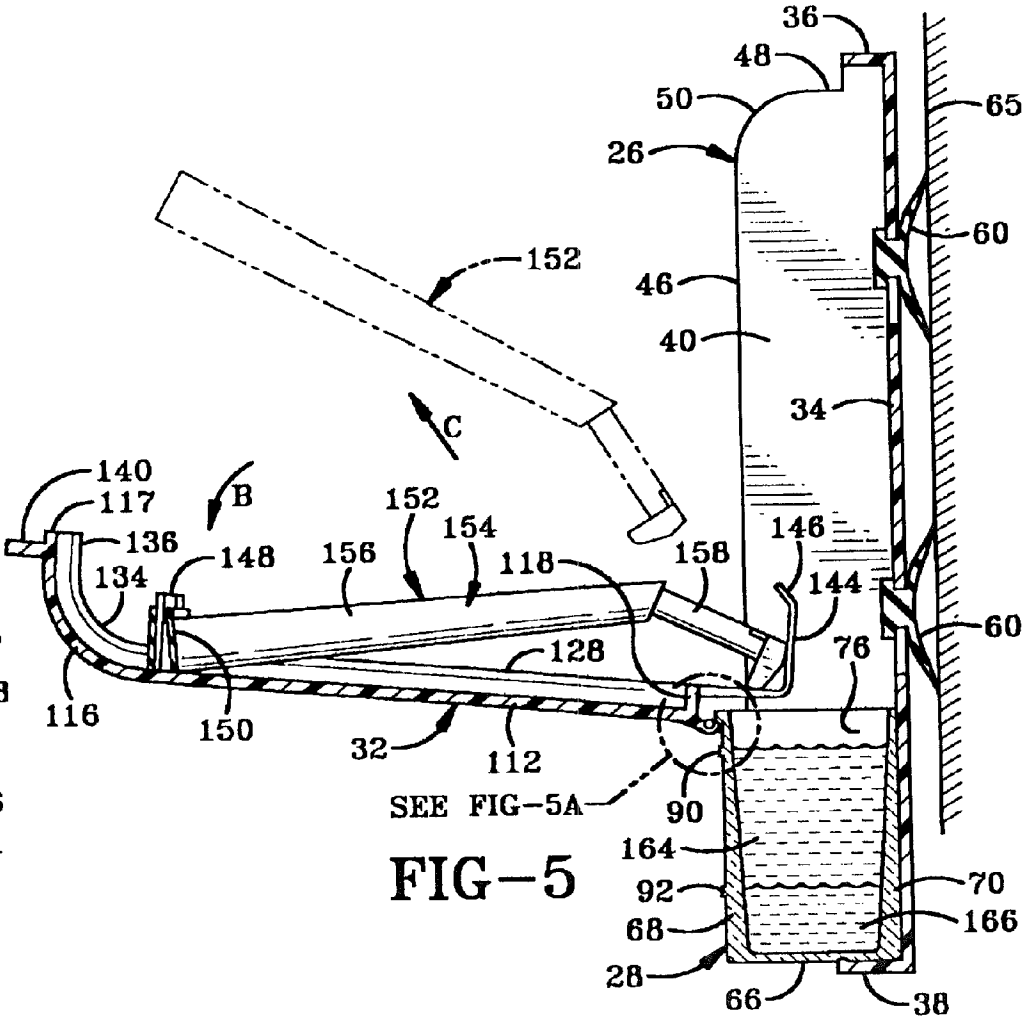
FIG. 5 is a sectional view similar to FIG. 4 showing the cover and shaver support in the open position.
Figure 8:
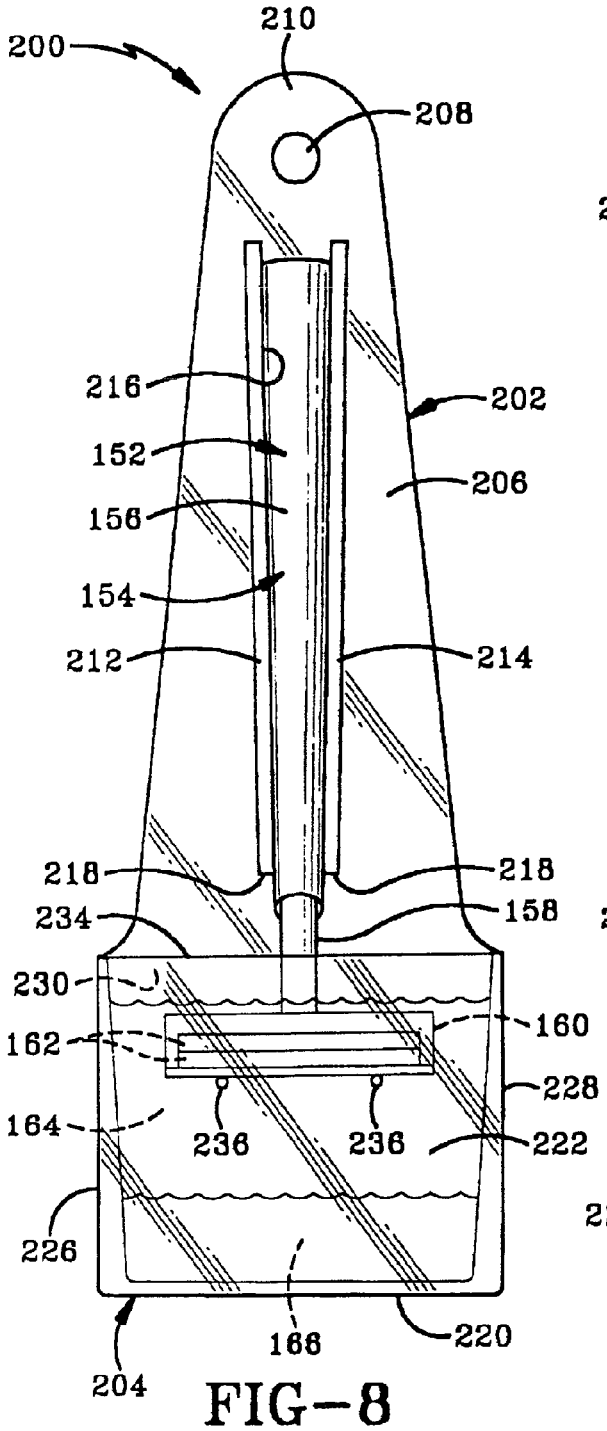
FIG. 8 is a front elevational view of a second embodiment of the shaver stand of the present invention.

A first embodiment of the shaver stand of the razor protection system of the present invention is shown at 10 in FIG. 1; and a second embodiment of the shaver stand of the present invention is shown generally at 200 in FIG. 8. Shaver stand 10 has a top 12, a bottom 14, a front 16, a back 18 and first and second sides 20 and 22 defining therebetween an axial direction of stand 10. Stand 10 is shown with its bottom 14 seated on an external support in the form of a horizontal upwardly facing surface 24 such as a counter top, table or the like. Stand 10 includes a generally upright member 26, a container 28 mounted on member 26 adjacent its lower end, a base 30 mounted adjacent the lower end of container 28 and a door or cover 32 which is pivotally mounted on container 28 adjacent its upper end to pivot relative to member 26, container 28 and base 30 about a horizontal axially extending axis A between a closed position (FIGS. 1, 4) and an open position (FIG. 5).

Upright member 26, container 28 and cover 32 are typically formed of substantially rigid materials and in the preferred embodiment are formed of a plastic material. Base 30 may also be formed of a plastic material which is substantially rigid or alternately be formed of a flexible material such as a rubber or elastomer which may serve as a suction cup for securing stand 10 to surface 24. Upright member 26 includes a substantially flat and vertical rectangular back wall 34, a horizontal top wall 36 rigidly secured to the top of back wall 34 and extending forward therefrom a short distance, a horizontal bottom wall 38 rigidly secured to the bottom of back wall 34 and extending forward therefrom a short distance and serving as a shelf or support, and first and second flat vertical sidewalls 40 and 42 which are axially spaced from one another and are rigidly secured to the sides or edges of back wall 34 and extend forward therefrom a distance which is further than that of top and bottom walls 36 and 38. Sidewalls 40 and 42 at their top ends are secured to top wall 36 by a respective pair of arcuate transitioning wall portions. Top wall 36 extends forward to a terminal forward facing front edge 44 which is horizontal and curves axially outwardly and downwardly at the curved transition wall portions. Each of sidewalls 40 and 42 has a vertical forward facing front edge 46, a horizontal upwardly facing top edge 48 which intersects front edge 44 and extends forward therefrom, an arcuate edge 50 which curves convexly forward and downwardly from top edge 48 to vertical edge 46, and a horizontal bottom edge 52 which faces downwardly and extends perpendicularly from the bottom of vertical edge 46 to back wall 34. Horizontal bottom edges 52 are spaced upwardly from bottom wall 38. A projection in the form of an axially elongated ridge 54 is secured to and extends upwardly from bottom wall 38 adjacent it front edge.

A pair of vertically aligned and vertically spaced through holes are formed in back wall 34 from its front to its back each including an upper narrower portion 56 and a lower wider portion 58 which is axially wider than portion 56. A pair of suction cups 60 may be mounted via these through holes via a neck 62 which is secured to suction cup 60 and extends forward therefrom and an enlarged head 64 secured at the front end of neck 62 whereby head 64 fits through the respective wider portion 58 of the through hole by forward movement and neck 62 slides upwardly into the narrower portion 56 of the hole whereby head 64 prevents the rearward removal of suction cup 60 from back wall 34 to secure suction cup 60 to back wall 34. Suction cups 60 thus provide one mounting mechanism for mounting stand 10 on an external vertical surface 65 (FIG. 5). Suction cups 60 may provide the sole support for stand 10 whereby stand 10 is suspended from suction cups 60 or suction cups 60 may be used to help secure stand 10 in place while also seated on a horizontal surface such as surface 24 (FIG. 1).

Container 28 is formed of a transparent material and includes a rectangular bottom wall 66, rectangular front and back walls 68 and 70 rigidly secured to and extending upwardly from bottom wall 66, and first and second rectangular sidewalls 72 and 74 rigidly connected to the sides of bottom wall 66 and extending upwardly therefrom and from front wall 68 to back wall 70. Walls 66, 68, 70, 72 and 74 define therewithin an upwardly opening liquid-receiving cavity 76. Front and back walls 68 and 70 terminate respectively at horizontal axially extending parallel top edges 78 and 80. Likewise, sidewalls 72 and 74 terminate at horizontal parallel upwardly facing top edges 82 and 84 which are perpendicular to edges 78 and 80 and extend therebetween. Top edges 78, 80, 82 and 84 define a top entrance opening 86 of cavity 76. An axially elongated groove 88 is formed in bottom wall 66 extending upwardly from its bottom surface and is configured to receive ridge 54 to form a snap-fit connection between container 28 and upright member 26 to removably secure container 28 thereto. Another releasable snap-fit connection is typically formed adjacent the top of container 28 with back wall 34 or sidewalls 40 and 42 although container 28 may be mounted on upright member 26 by any suitable mechanism. Top edges 84 engage bottom edges 52 when container 28 is mounted on upright member 26. An upper liquid level marker 90 in the form of a horizontal line is formed on front wall 68 and a lower liquid level marker 92 is formed on front wall 68 therebelow. Upper liquid level marker 90 is spaced downwardly from top edge 78 and substantially above bottom wall 66. Lower marker 92 is spaced downwardly from upper marker 90 and spaced upwardly a short distance from bottom wall 66. Markers 90 and 92 in the exemplary embodiment project forward a short distance and are integrally formed with front wall 68. However, they may also be formed as indentations, with paint or another coating, and so forth. Three axially spaced hinge members are secured to and extend forward from front wall 68 adjacent top edge 78, each including a pivot 94 through which axis A passes. Each hinge member includes a stop 96 (FIGS. 4A, 5A) which projects outwardly from front wall 68 and faces downwardly.

Base 30 includes a stepped bottom wall 98, a front wall 100 and a back wall 102, and first and second sidewalls 104 and 106 which define therewithin an interior chamber or upwardly opening cavity 108 for receiving therein bottom wall 38, a lower portion of back wall 34 and the lower portion of lower container 28. Container 28 is typically removably mounted within cavity 108 simply by a friction fit. Base 30 further includes a generally U-shaped flange 110 which is secured to and extends outwardly from front wall 100 and sidewalls 104 and 106 to provide greater stability to stand 10.

Cover 32 includes a vertical flat substantially rectangular and relatively large front wall 112, a relatively small flat rectangular top wall 114, and an arcuate transitioning wall 116 which curves upwardly and rearwardly from the top of front wall 112 to the front of top wall 114. Top wall 114 has a terminal rear edge 117 which faces rearwardly. A horizontal axially extending bottom wall 118 is secured to and extends rearwardly from the bottom of front wall 112 a short distance to a rearwardly facing horizontal edge 120. First and second vertical sidewalls 122 and 124 are connected to and extend rearwardly from the sides of front wall 112 to respective vertical terminal edges 126 and 128 which are coplanar with edge 120. Adjacent their upper ends, sidewalls 122 and 124 transition in an arcuate segment 130 to a horizontal segment 132. Arcuate segment 130 defines a concave arcuate edge 134 which faces rearwardly and downwardly while horizontal segment 132 defines a horizontal edge 136 which faces downwardly. Three axially spaced hinge members 138 are secured to front wall 112 adjacent its lower end and extend forward and downwardly therefrom. Each hinge member 138 defines an axially extending groove which receives a respective one of pivots 94 in a releasable snap-fit pivotal connection which provides for pivotal movement of cover 32 about pivots 94. A handle 140 projects upwardly from top wall 114 to facilitate opening and closing cover 32.

Figure 4:
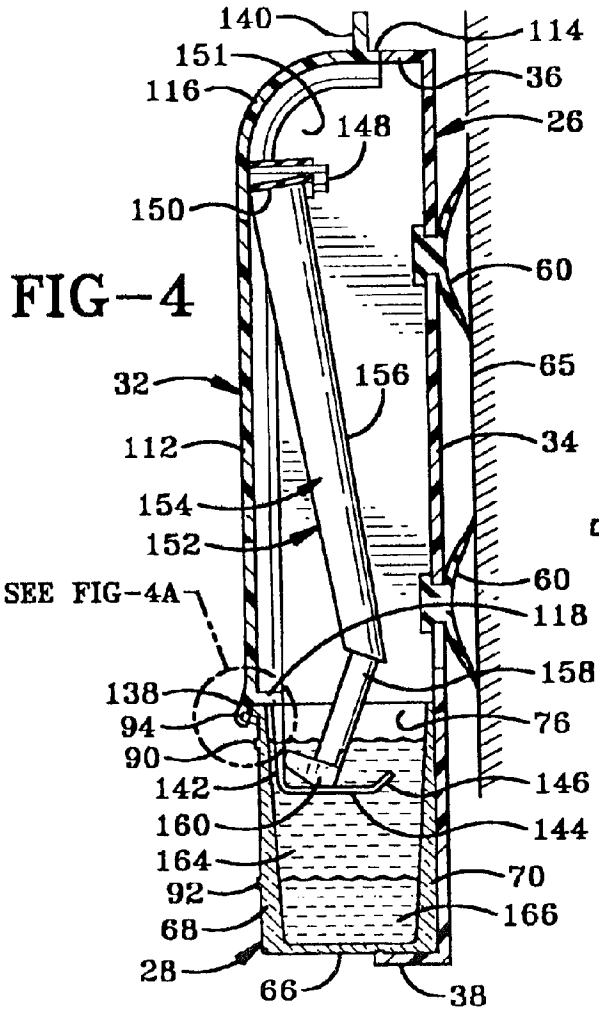
FIG. 4 is a sectional view taken on line 4-4 showing the cover and shaver support in the closed position.

In the closed position of cover 32, rear edge 117 forms a mating engagement with front edge 44 of top wall 36. Likewise, edges 126 and 128 form a mating engagement respectively with edges 46 of sidewalls 40 and 42 while edges 134 and 136 form a mating engagement with respective edges 50 and 48. In addition, the bottom of bottom wall 118 forms a mating engagement and is seated on top edge 78 of front wall 68 when door 32 is closed, as best shown in FIG. 4. Each mating engagement noted above means that the respective surfaces are closely adjacent or abutting one another and have complementary shapes preferably in a continuous manner around the entire outer perimeter of cover 32 so that cover 32 serves to substantially prevent water from inadvertently getting into container 28. Cover 32 typically forms a snap-fit engagement with upright member 26 adjacent the upper end of stand 10 to releasably secure cover 32 in the closed position. A shaver support is provided in the form of a pair of axially spaced cantilevered hook members each including a leg 142 which is connected to and extends vertically downwardly from bottom wall 118, a foot 144 which is connected to the bottom of leg 142 and extends substantially horizontally forward therefrom, and a tip 146 which is connected to the rear end of foot 144 and angles upwardly a short distance therefrom to a terminal free end. In the exemplary embodiment, these hook members are formed integrally with cover 32 as a one-piece member so that cover 32 may itself be referred to as a shaver support, a portion of which may serve as a cover portion. A pair of axially spaced posts 148 is secured to and extends rearwardly from front wall 112 adjacent its upper end and spaced downwardly from top wall 114. An elastic member typically in the form of a rubber band or another stretchable member typically utilizing an elastomer is secured to and extends between posts 148. In the exemplary embodiment, band 150 circumscribes posts 148.

Figure 3:
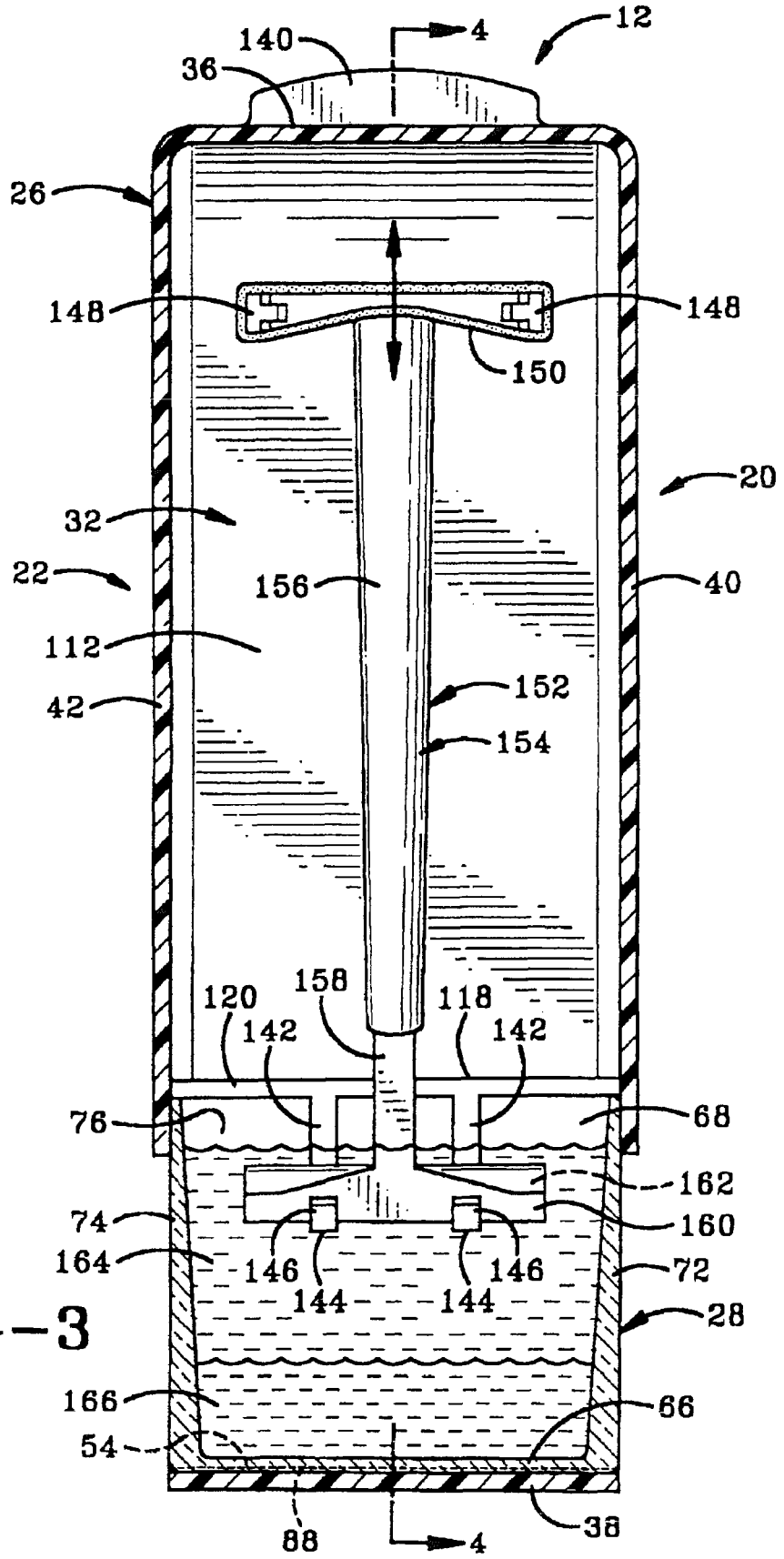
FIG. 3 is a sectional view taken on line 3-3 of FIG. 1 with the base removed for simplicity.

The operation of the razor protection system is now described with reference to FIGS. 3-7. Referring first to FIGS. 3-5, stand 10 is used with a non-electric shaver 152 which includes an elongated handle 154 typically having and elongated grip 156 and neck 158 with a head 160 connected to neck 158 and extending perpendicularly thereto and outwardly therefrom in opposite directions to form a generally T-shaped configuration. Head 160 carries one or more metal razors 162 each of which is protected from oxidation by the present system. When cover 32 is closed, upright member 26 and cover 32 serves as housing members of a housing and define therebetween an interior chamber 151 (FIG. 4) which is directly above and communicates with cavity 76 of container 28. Thus, posts 148 and elastic member 150 are disposed within interior chamber 151. When shaver 52 is mounted on stand 10, and door 32 is closed, most of handle 154 is disposed within interior chamber 151 while head 160 and the lower portion of neck 158 are disposed within cavity 76 of container 28. When cover 32 is closed, top wall 114, handle 140 and a majority of arcuate wall 116 are disposed directly above cavity 76. Portions of posts 148, elastic member 150 and bottom wall 118 are likewise disposed directly over cavity 76. In the open position of cover 32, none of these components are directly above cavity 76 but rather extend forward thereof.

Razor 162 is protected by a protective liquid 164 typically in the form of mineral oil or the like which is disposed within cavity 76 of container 28 and floats as a layer atop a layer of water 166 also contained within cavity 76 in direct contact with bottom wall 66. Protective liquid 164 thus has a lower density than that of water. Typically, liquid 164 and water 166 are added to container by the user prior to use of stand 10. However, protective liquid 164 may be added by itself in the beginning while water 166 may be added subsequently by the user pouring water into cavity 76 or by accumulation via water which drips from shaver 152. In any case, protective liquid 164 is added so that it is about level with the upper level marker 90 (FIG. 4). Head 160 of shaver 152 is thus seated on feet 144 which serve as a head shelf of the shaver support so that in the closed position of cover 32, head 160 and razor 162 are immersed in protective liquid 164 within an immersion zone typically defined above feet 144 and below marker 90. The immersion zone may be up to or above marker 90 as well, even up to the top of container 28 but preferably spaced downwardly therefrom a distance sufficient to prevent overflow of liquid 164 when head 160 is immersed.

Figure 4A:
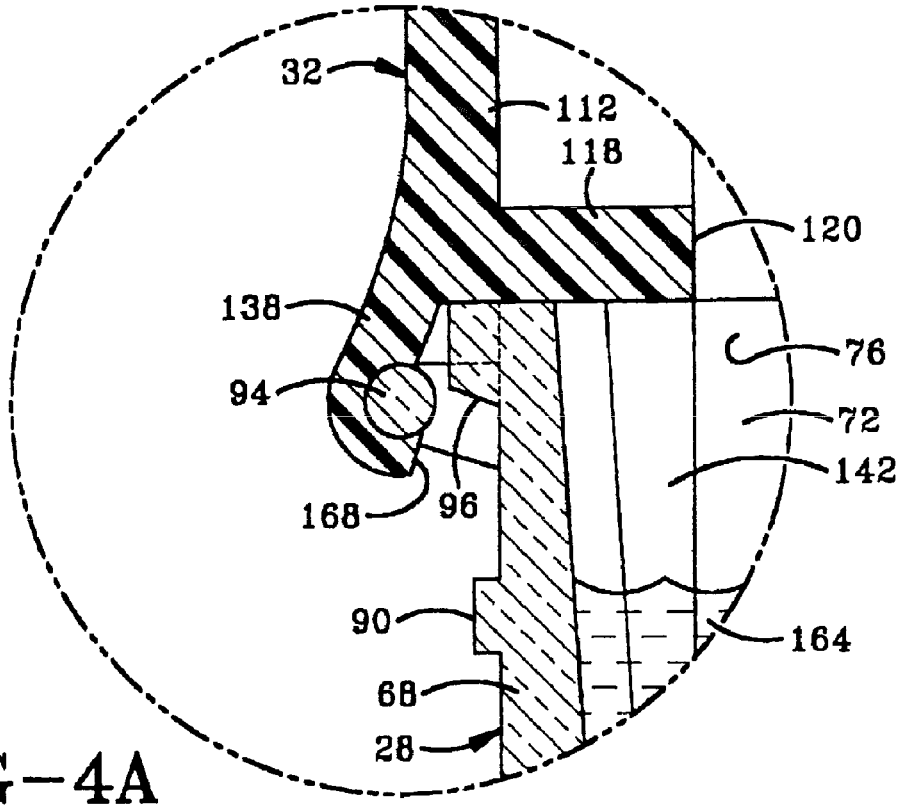
FIG. 4A is an enlarged sectional view of the encircled portion of FIG. 4.
Figure 5A:
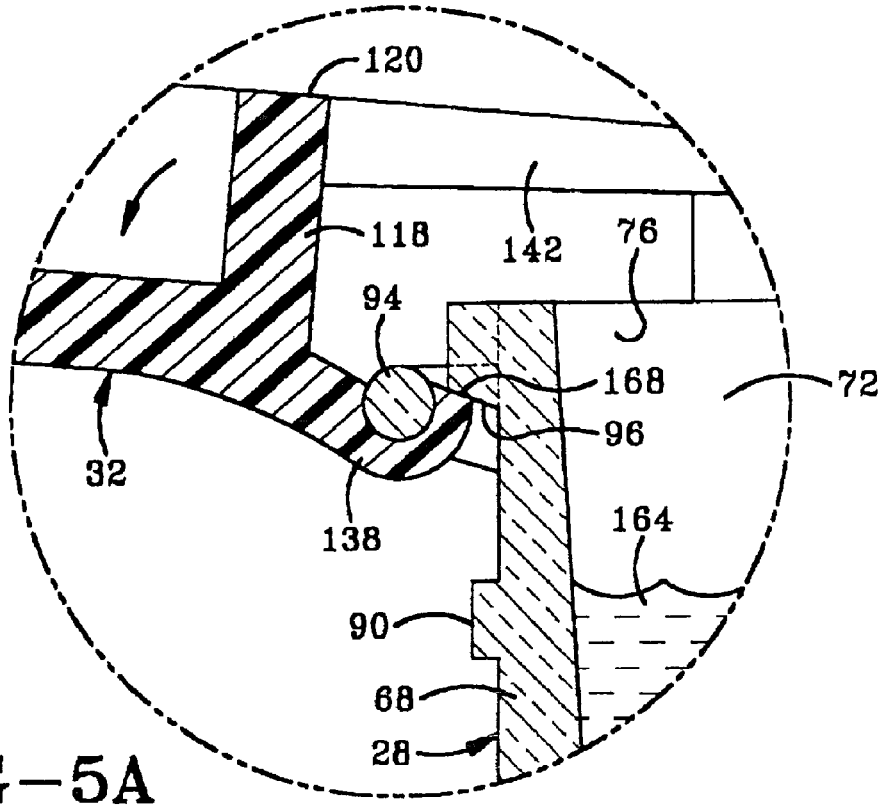
FIG. 5A is similar to FIG. 4A and is an enlarged sectional view of the encircled portion of FIG. 5.

Thus, when door 32 is closed, the shaver support is in an immersed position in which the lower portions of leg 142 along with feet 144 and tips 146 are immersed in protective liquid 164 and thus below level marker 90, as shown in FIG. 4. When door 32 and the shaver support are pivoted to the open position shown in FIG. 5, the shaver support is in a non-immersed position in which legs 146, feet 144 and tips 146 are completely removed from liquid 164. During the movement from the closed position to the open position, legs 142 thus move from a substantially vertical position to a substantially horizontal position while feet 144 move from a substantially horizontal position to a substantially vertical position. In the immersed position, head 160 of shaver 152 is seated on and directly supported by the upper surfaces of feet 144 whereas in the non-immersed position head 160 is seated on the lower portion of legs 142 adjacent feet 144. As shown in FIG. 5, head 160, the lower portion of leg 142, feet 144 and tips 146 are positioned directly above cavity 76 and liquid 164 so that any of liquid 164 which is retained on these components may drip into cavity 76 in the open and non-immersed positions. Preferably legs 142 angle downwardly from front to back so that liquid 164 will tend to drip into cavity 76 rather than outside container 28. As best shown in FIGS. 4A and 5A, each hinge member 138 includes a stop surface 168 which is out of contact with stop 96 in the closed position of cover 32 and which engages stop 96 in the open position of cover 32 in order to limit the forward and downward rotation of the upper end of cover 32.

Although the amount of rotation between the closed and open positions of cover 32 may vary, in the exemplary embodiment cover 32 rotates approximately 85 degrees between the two positions. Depending on the configuration of the shaver used with stand 10 and other factors, there is sometimes a tendency for the upper end of the shaver handle to tip rearwardly when cover 32 is in the closed position. Amongst other things, this can cause a problem with the engagement of the upper end of handle 154 jamming against top wall 36 of upright member 26 when cover 32 is opened. Stand 10 thus provides the handle retaining mechanism which utilizes posts 48 and elastic member 150 to prevent the upper end of handle 154 from tipping in this manner. More particularly, the user will position shaver 152 so that upper end of handle 154 pushes against elastic member 150 to stretch member 150 to a position such as that shown in FIGS. 3-5 so that elastic member 150 applies a force on shaver 152 which is translated to a force applied by shaver 152 to feet 144 via head 160. Other handle retaining mechanisms may be utilized although this configuration is simple and cost effective. In addition, front member 26 may be formed without top wall 36 to eliminate the jamming of handle 154 against such a wall when cover 32 is open. Thus, when the user wishes to use shaver 152, he or she opens cover 32 by applying a forward force on handle 140 to pivot the top of cover 32 forward and downwardly as indicated at Arrow B in FIG. 5 to the open position in which stop surface 168 abuts stop 96. Shaver 152 is then lifted upwardly as indicated at Arrow C to overcome the spring bias of elastic member 150 so that the user may shave with shaver 152. When cover 32 is open, a portion of handle 154 may also rest upon front wall 112 of cover 32 whereby cover 32 provides a handle support in the open position aside from the use of the handle retaining mechanism including elastic member 150.

Figure 6:
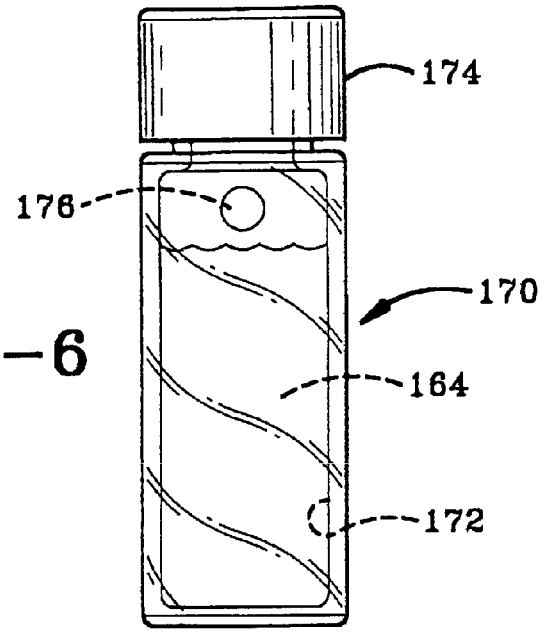
FIG. 6 is a side elevational view of the vial containing the protective liquid used for filling or refilling the container of the shaver stand.

The razor protection system and its operation is now further described with reference to FIGS. 6-7. The system may further include a vial 170 which defines an interior chamber 172 and includes a closure member shown here in the form of a screw-on cap 174 which may be screwed onto a threaded neck of vial 170 to form a sealed vial for sealing therein a predetermined amount of protective liquid 164 within chamber 172. In a preferred embodiment, a dye 176 is also contained in interior chamber 172 which is used to color water 166 when used in container 28 of stand 10. It is generally preferred that at least one of water 166 and protective liquid 164 is colored so that the two layers of liquid 164 and water 166 when disposed in container 28 may be easily distinguished. It has been found that the mineral oil that is often used in the razor protection systems is substantially as clear as water and thus it is difficult to distinguish between the two. Thus, dye 176 is typically soluble in water 166. In a low cost embodiment, dye 176 may be a readily available food color which is soluble in water. In order to protect against breakage of vial 170 when it is exposed to freezing temperatures particularly when dye 176 is a water based dye, it is preferred that only a relatively small amount of dye 176 is contained within vial 170. Typically, only a drop or a few drops is necessary to dye the water when used subsequently and thus avoids this breakage problem which might occur with the freezing of a larger volume of water based dye in vial 170.

Figure 7:
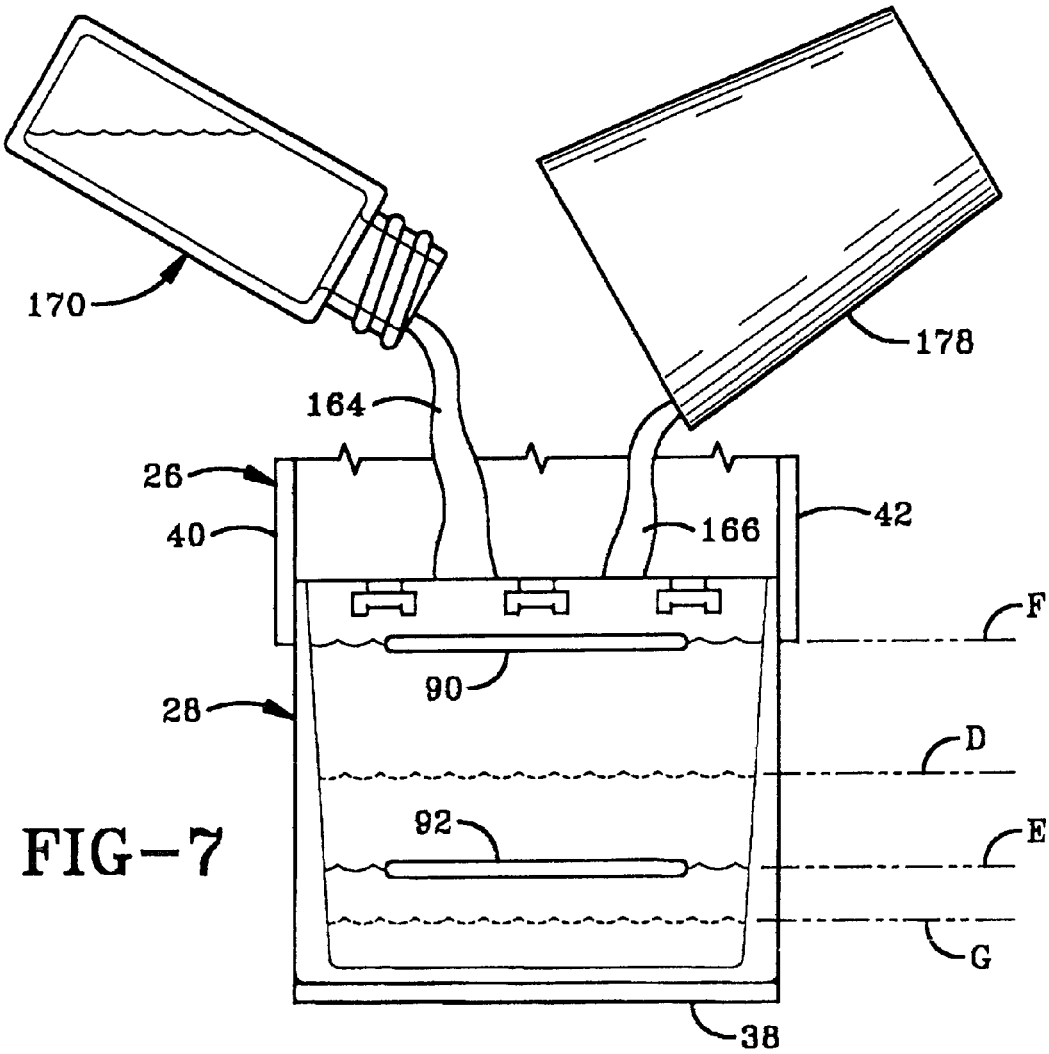
FIG. 7 is a front elevational view of the lower portion of the stand showing protective liquid being poured from the vial into the container and water being poured from a cup into the container.

As shown in FIG. 7, once cap 174 has been removed, protective liquid 164 and dye 176 may be poured into container 28. FIG. 7 also shows water 166 being poured from a cup 178 into container 28. Thus, for initial use or during the refilling of container 28 once it has been cleaned out, the premeasured amount of protective liquid 164 may be poured first into container 128 to bring the amount of liquid 164 therein up to a preliminary level indicated at line D in FIG. 7. Water 166 may then be poured from cup 178 into container 28 to raise the level of water 166 within container 128 to lower level marker 92 or the level indicated at line E whereby protective liquid 164 floats atop water 166 and moves upwardly to upper level marker 90 or the level indicated at line F. As water 166 is poured into container 28, dye 176 is dissolved therein to color water 166 so that the colored water 166 and protective liquid 164 are easily distinguished. The order of adding liquid 164 and water 166 is typically not important since liquid 164 will float on water 166. The level indicated at line G may represent an initial level of water within container 28 which is insufficient to maintain the level of protective liquid 164 at markers 90. Thus, additional water 166 may be added to move the level of liquid 164 up to marker 90 at any given time.

During regular use of shaver 152 the level of liquid 164 will gradually drop due to the removal of small amounts of liquid 164 on head 160. To compensate for this loss, a suitable amount of water 166 may simply be added to container 28 to raise the level of liquid 164 up to marker 90 so that razor 162 will always be immersed when cover 32 is closed. After some time, the repeated addition of water 166 to container 28 may raise the level of water 166 to a level which would contact razor 162. However, this is easily avoided especially due to the different coloring of liquid 164 and water 166 which makes it easily discernible whether razor 162 is immersed in water. Most typically however, the clippings of hair which accumulate within container 28 over time will prompt the user to clean out container 28 and start over again with a new batch of protective liquid 164 and water 166, which typically avoids the issue of immersing razor 162 in water 166 within container 28.

Figure 9:
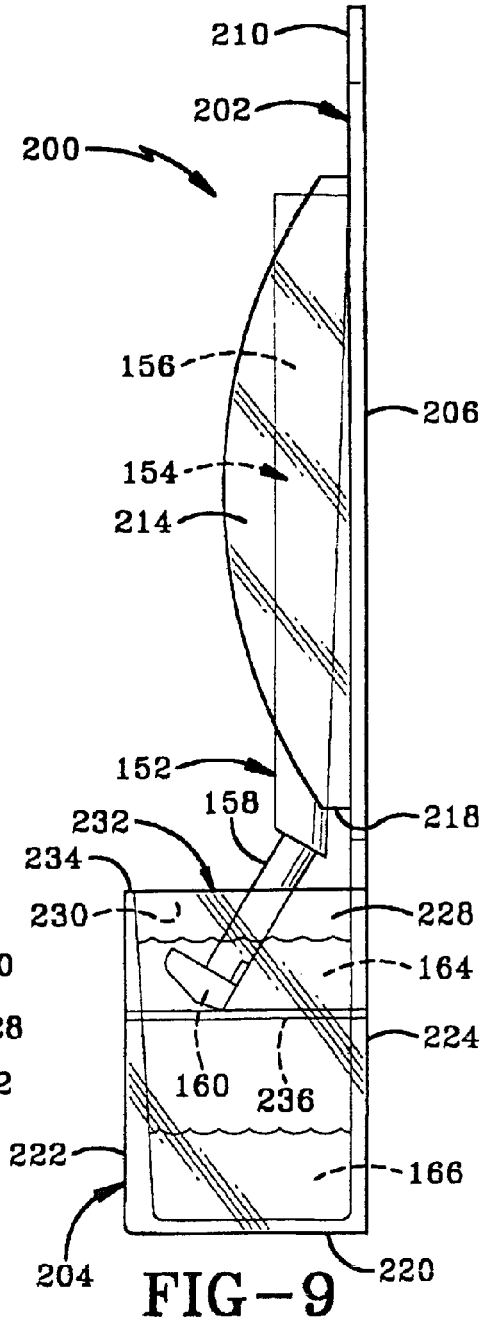
FIG. 9 is a side elevational view of the second embodiment.

Shaver stand 200 is now described with reference to FIGS. 8 and 9. Stand 200 includes an upright member 202 which is rigidly secured to and extends upwardly from a container 204 having a configuration similar to that of container 28. Upright member 202 includes a flat vertical back wall 206 defining a through hole 208 adjacent its upper end whereby back wall 206 includes a hanger 210 so that stand 200 may be hung from a post extending through hole 208 with hanger 210 seated thereon, such as is commonly found on a shower rack. Upright member 26 includes a handle retaining mechanism including first and second projections in the form of walls 212 and 214 which are generally vertical and extend forward from back wall 206. Walls 212 and 214 are axially spaced from one another and taper slightly downwardly and toward one another from top to bottom to define therebetween a slightly tapered handle receiving space 216 for receiving therein tapered handle 154 of shaver 152. Walls 212 and 214 may be formed of substantially rigid material or may be formed of material which allows for some flexing in order to allow for the insertion of shaver handles of different widths. As shown in FIG. 9, the front edges of walls 212 and 214 are convexly arcuate so that a portion of each of the walls extends forward beyond handle 154 when received in space 216. Each of walls 212 and 214 at its lower end define a substantially horizontal downwardly facing shaver engaging or head engaging surface 218.

Container 204 contains five substantially rectangular walls, including horizontal bottom wall 220, front and rear walls 222 and 224 which are secured to and extend upwardly from the front and back of back of bottom wall 220, and first and second 226 and 228 which are secured to and extend upwardly from opposed sides of bottom wall 220 and are respectively connected to front and back walls 222 and 224 to define therewithin an upwardly opening liquid-receiving cavity 230 having at its top an entrance opening 232 through which liquid and head 160 of shaver 152 may be received. Back wall 206 of upright member 202 is secured to and extends upwardly from the top of back wall 224 of container 204 and in the exemplary embodiment the two back walls are formed as an integral one-piece member. Moreover, upright member 202 and container 204 in the exemplary embodiment are formed as an integral one-piece member typically formed of plastic and in the exemplary embodiment a transparent plastic material. Front wall 222 and sidewalls 226 and 228 extend upwardly to terminate at an upwardly facing top edge 234. As shown in FIG. 9, walls 212 and 214, including surfaces 218, are positioned directly above cavity 230 of container 204. While the handle retaining mechanism comprising walls 212 and 214 may be used to support shaver 152 with head 160 and razors 162 immersed in protective liquid 164, stand 200 also includes another shaver support including a pair axially spaced posts 236 which are secured to and extend between front wall and back wall 224 downwardly from top edge 234 a distance sufficient to provide for the immersed position of head 160 and razors 162 within cavity 230. Posts 236 thus serve as a head shelf on which head 160 is seated in the immersed position of shaver 152 shown in FIGS. 8 and 9. Stand 200 will typically include a cover or lid which is movable between closed and open positions for respectively covering cavity 230 and providing access thereto. The cover or lid is not shown in the figures but may be formed similar to cover 32 or may be a cover which slides or snap-fits between the open and closed positions with or without pivoting and may be entirely removable from upright 202 and container 204. The lid or cover in its closed position thus prevents water from inadvertently entering cavity 230 such as when used in the shower.

Figure 10:
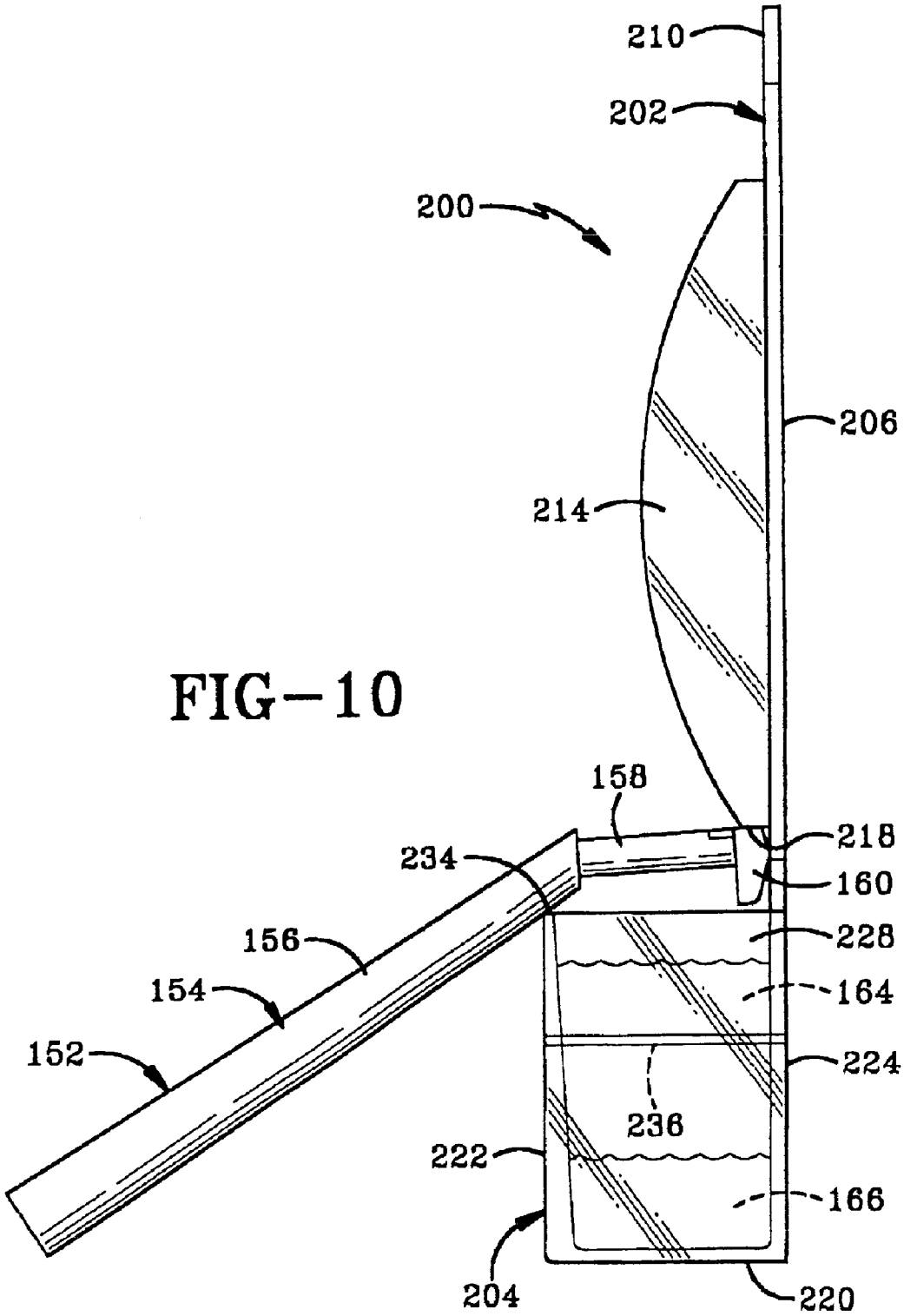
FIG. 10 is similar to FIG. 9 and shows the shaver in a dripping position.

When the user of shaver 152 is ready to shave he or she may simply manually grasp shaver 152 to remove it from between walls 212 and 214 and if desired, move shaver 152 to the dripping position shown in FIG. 10 to allow protective liquid 164 to drip therefrom prior to use. In the dripping position, head 160 of shaver 152 engages surfaces 218 while handle 154 rests on top edge 234 of front wall 222, which serves as a fulcrum so that the weight of or gravitational downward force on handle 154 forward of front wall 222 creates an upward force on head 160 which is translated to surfaces 218. This configuration thus holds shaver 152 in the dripping position. As evident from FIGS. 8-10 container 204 does not include a liquid level marker such as marker 90 or marker 92 of stand 10. However, the user may visually ascertain with relative ease whether there is a sufficient amount of protective liquid 164 within cavity 230. The procedure for filling cavity 230 and cleaning it out is the same as that with stand 10 except for the use of liquid level markers.

Thus, the razor protection system of the present invention provides for the protection of razors of non-electric shavers in which the razors may be positioned in an immersion position immersed in the protective liquid or a dripping position in order to allow the protective liquid to drip into its container. Each of stand 10 and 200 provides a simple securing mechanism for securing the stand to a horizontal surface, a vertical surface or a post or the like from which it may hang. Each embodiment also provides a shaver support and handle retaining mechanism which releasably secures the shaver in it immersed position. In addition, the system provides for maintaining the level of the protective liquid using water as a lift mechanism wherein the protective liquid floats atop the water and whereby water alone may be added in order to raise the level of the protective liquid to the desired level to maintain a sufficient submersion zone to insure that the razors will always be immersed when positioned on the respective shaver support.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described.

The invention claimed is:

1. A method comprising the steps of:

pouring water into a liquid-receiving cavity formed in a container;

floating a protective liquid on the water within the cavity; and supporting with a shaver support a shaver in a first position in which a razor of the shaver is immersed in the protective liquid to protect the razor against oxidation and the razor is out of contact with the water.

2. The method of claim 1 wherein the step of pouring comprises the step of pouring water from a cup into the cavity.

3. The method of claim 1 wherein the step of pouring comprises the step of pouring water into the cavity so that the water reaches a lower liquid level marker on the container; and the step of floating comprises the step of floating the protective liquid so that the protective liquid reaches an upper liquid level marker on the container.

4. The method of claim 3 further comprising, prior to the step of pouring water into the cavity, the step of placing the protective liquid in the cavity to bring the protective liquid up to a preliminary level which is higher than the lower marker.

5. The method of claim 1 further comprising the steps of removing the razor from the protective liquid so that some of the protective liquid is removed from the cavity on the shaver, thereby causing a level of the protective liquid within the cavity to drop; and adding water to the cavity after the step of removing to raise the level of the protective liquid.

6. The method of claim 5 wherein the step of adding comprises the step of adding a suitable amount of water to the cavity to compensate for the removal of the protective liquid.

7. The method of claim 5 wherein the step of adding comprises the step of raising the level of the protective liquid to ensure that the razor will be immersed when the razor is in the first position.

8. The method of claim 7 wherein the step of adding comprises the step of raising the level of the protective liquid to a liquid level marker on the container.

9. The method of claim 5 wherein the step of removing comprises the step of causing the protective liquid to drop from a first level to a second level; and the step of adding water comprises the step of raising the level of the protective liquid from the second level to the first level.

10. The method of claim 1 further comprising the step of coloring one of the water and the protective liquid with a dye to facilitate the ability to distinguish the water from the protective liquid.

11. The method of claim 1 further comprising the step of applying a force on a handle of the shaver with an elastic member so that the force is transferred to the shaver support via a head of the shaver which carries the razor.

12. A razor protection system for use with a shaver having a handle, a head secured to the handle and a razor carried by the head, the system comprising:

a container;

a liquid-receiving cavity formed in the container;

a lower layer of water in the cavity;

an upper layer of protective liquid which floats on the lower layer in the cavity and is suitable for protecting against oxidation of the razor when immersed therein; and a shaver support adjacent the container adapted to support the shaver with the razor immersed in the upper layer and out of contact with the lower layer; in combination with the shaver; and further comprising an elastic member which is adjacent the container and applies a force on the handle of the shaver so that the force is transferred to the shaver support via the head of the shaver.

13. The system of claim 12 wherein one of the water and the protective liquid is colored to facilitate the ability to distinguish the water from the protective liquid.

14. The system of claim 12 wherein the elastic member is formed of an elastomer.

15. A razor protection system for use with a shaver having a handle, a head secured to the handle and a razor carried by the head, the system comprising:

a container;

a liquid-receiving cavity formed in the container;

a lower liquid level marker on the container adapted to indicate a fill level of water when disposed in the cavity;

an upper liquid level marker on the container adapted to indicate a fill level of a protective liquid which has a density less than that of water and which is suitable for protecting against oxidation of the razor when immersed therein; and a shaver support adjacent the container adapted to support the shaver with the razor within the cavity higher than the lower marker and lower than the upper marker; in combination with the shaver; and further comprising an elastic member which is adjacent the container and applies a force on the handle of the shaver so that the force is transferred to the shaver support via the head of the shaver.

16. The system of claim 15 in combination with the water and protective liquid; and wherein the water is disposed in the cavity at a level which is about at the lower marker; and the protective liquid floats on the water in the cavity at a level which is about at the upper marker.

17. The system of claim 15 further comprising a premeasured amount of the protective liquid; and wherein the premeasured amount of the protective liquid when placed in the cavity by itself has a level higher than the lower marker and lower than the upper marker.

18. The system of claim 17 in combination with the water and protective liquid; and wherein the water is disposed in the cavity at a level which is about at the lower marker; and the protective liquid floats on the water in the cavity at a level which is about at the upper marker.

* * * * *